United States Patent [19]

Leakey et al.

[11] 4,067,491

[45] Jan. 10, 1978

[54] LEAK-PROOF BOX

[75] Inventors: Joseph W. Leakey, Danville; Ray H. Stollberg, Antioch, both of Calif.

[73] Assignee: Crown Zellerbach Corporation, San Francisco, Calif.

[21] Appl. No.: 791,259

[22] Filed: Apr. 27, 1977

[51] Int. Cl.[2] ..... B65D 5/02

[52] U.S. Cl. ..... 229/23 R; 229/37 R

[58] Field of Search ..... 229/23 R, 37 R; 93/51 M

[56] References Cited

U.S. PATENT DOCUMENTS

| | | | |
|---|---|---|---|
| 1,697,709 | 1/1929 | Bliss | 229/23 R |
| 1,921,150 | 8/1933 | Bomberger | 229/37 R |
| 1,987,647 | 1/1935 | Wellman | 229/37 R |
| 2,187,304 | 1/1940 | Farmer | 229/37 R |
| 2,769,589 | 11/1956 | Moore | 229/37 R |
| 3,094,265 | 6/1963 | Hovland | 229/37 R |
| 3,146,933 | 9/1964 | Moore | 229/37 R X |
| 3,261,536 | 7/1966 | Bixler | 229/37 R |

*Primary Examiner*—Davis T. Moorhead

*Attorney, Agent, or Firm*—Thomas R. Lampe

[57] ABSTRACT

A leak-proof box formed of three individual blanks having cooperating glue flaps secured at the corners of the box and sealer flaps which provide leak-proof seals at the upper box corners and along the upper ends of the box when a top closure panel is secured into position.

6 Claims, 9 Drawing Figures

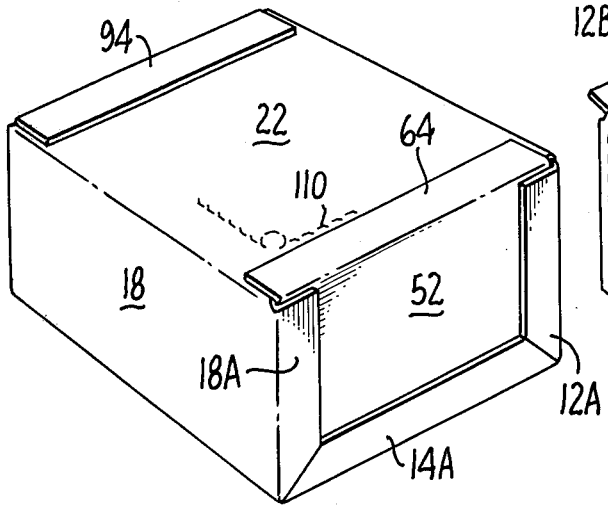
FIG. 1.
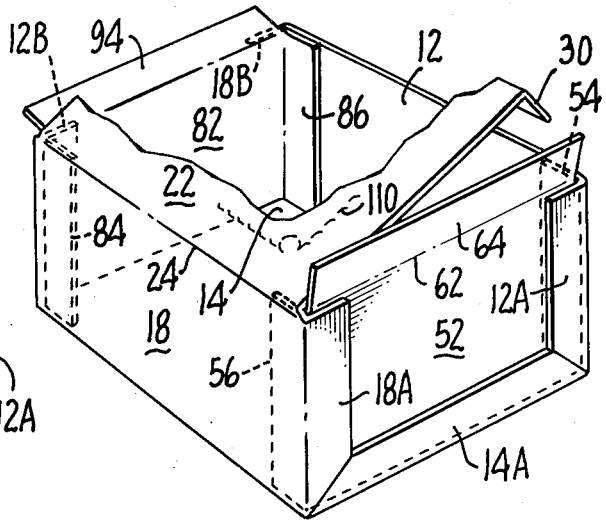
FIG. 2
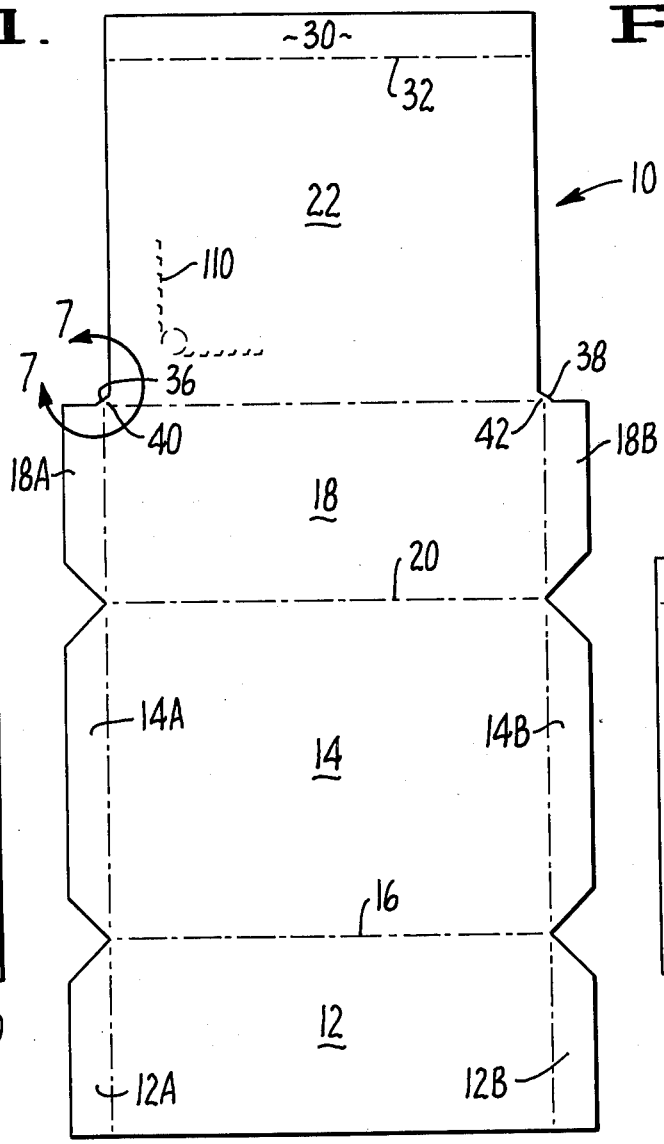
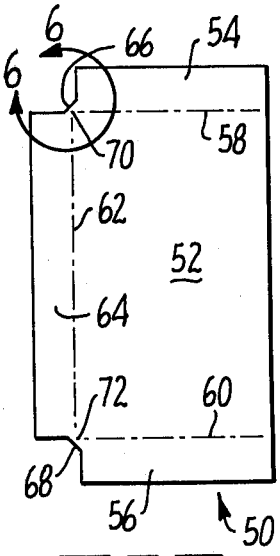
FIG. 4.
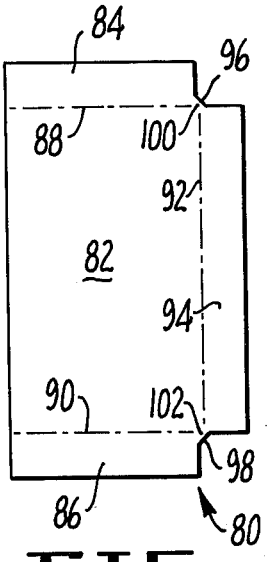
FIG. 5.
FIG. 3.

LEAK-PROOF BOX

BACKGROUND OF THE INVENTION

This invention relates to containers of the so-called "Bliss-type" exemplified by U.S. Pat. No. 1,697,709 to Bliss, dated Jan. 1, 1929, having inside and outside flanges at each corner; the flanges providing stacking strength. Containers of the Bliss-type are formed of three units or blanks of corrugated board or other suitable material; and in the set-up container an inside flange is secured to the inside surfaces of the adjacent front and back walls of the container and an outside flange is secured to the outside surface of the end walls. While the pair of upright flanges at each corner has provided desirable stacking strength, containers of the type illustrated in U.S. Pat. No. 1,697,709 have not been suitable for the storage and transport of granular or powdery substances in bulk since leakage of such substances occurs at the upper box corners.

SUMMARY AND OBJECTS OF THE INVENTION

According to the present invention a Bliss-type box is provided which not only provides desirable stacking strength but also incorporates a construction rendering the box leak-proof so that it may be utilized in the transport of powdered or granular materials, such as bulk salt, sugar or the like.

This objective has been attained in accordance with the present invention by providing a leak-proof box comprising a main body blank of unitary construction and including a front panel, a bottom panel connected to the front panel, a back panel connected to the bottom panel, a top closure panel connected to the back panel along the hinge line and a closure flap connected to the top closure panel and adapted to be brought into engagement with the front panel to close the box. Glue flaps are attached along hinge lines to the ends of the bottom, front and back panels. A pair of end panels is disposed in communication with the front, bottom and back panels at the ends thereof, the front, bottom and back panel glue flaps overlapping the end panels and secured to the outer surfaces thereof. Glue flaps are also attached to the end panels along hinge lines and secured in engagement with the inner surfaces of the front and back panels. Sealer flaps are hingedly connected to each end panel and are adapted to be folded inwardly over the top closure panel to form leak-proof seals therewith when the closure flap is secured to the front panel.

Other objects will become apparent from the following more detailed description and accompanying drawings in which:

DESCRIPTION OF DRAWINGS

FIG. 1 is an isometric view of the box hereof in fully assembled and set-up condition;

FIG. 2 is a view similar to FIG. 1 but showing the top closure panel partially open and details of selected elements of the box in phantom;

FIG. 3 is a plan view of a first blank or unit of material from which the box is made;

FIG. 4 is a plan view of a second blank of this material;

FIG. 5 is likewise a plan view of the third blank;

DETAILED DESCRIPTION

Figure 7:
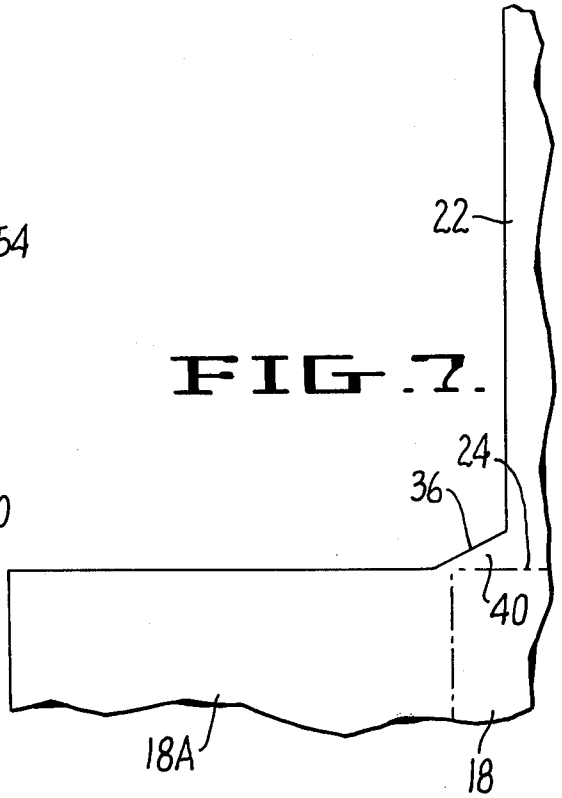

The box hereof is known in the trade as a Bliss-type, which is formed of three individual pieces or blanks that can be readily erected to set-up position by the apparatus and method disclosed in assignee's U.S. Pat. No. 3,659,505, dated May 2, 1972. A first of such blanks 10, illustrated in FIGS. 3 and 7, comprises a front panel 12, a bottom panel 14 connected to the front panel along a hinge line 16, a back panel 18 connected to bottom panel 14 along a hinge line 20 and a top closure panel 22 connected to the back panel 18 along a hinge line 24. A closure flap 30 is connected to the top closure panel 22 along a hinge line 32.

It may be seen that front, bottom and back panels 12, 14 and 18 have glue flaps attached thereto along hinge lines. The glue flaps associated with front panel 12 are designated by reference numerals 12A, 12B, the glue flaps associated with bottom panel 14 by reference numerals 14A, 14B and the glue flaps associated with back panel 18 by reference numerals 18A, 18B. Top closure panel 22 is connected to glue flaps 18A and 18B of back panel 18 along diagonal lines of cut 36 and 38, which define auxiliary seal portions 40 and 42, the purpose of which will be set forth in detail below.

Figure 6:
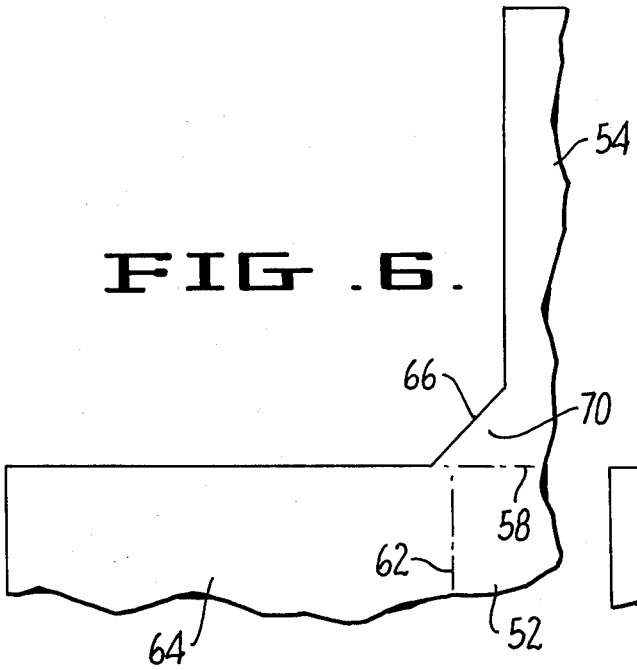
FIGS. 6 and 7 are side views showing details of the leak-proof corners of the second and first box blanks, respectively.

Referring now to FIGS. 4 and 6, the second blank utilized in the construction of the box in accordance with the present invention is illustrated. The second blank, generally identified by reference numeral 50 includes a rectangularly-shaped end panel 52. Glue flaps 54 and 56 are hingedly connected at opposed ends of the end panel 52 along hinge lines 58 and 60. Also connected to end panel 52 along a hinge line 62 is a sealer flap 64. Sealer flap 64 is connected to glue flaps 54, 56 along diagonal lines of cut 66 and 68 which define primary seal portions 70 and 72 at the corners.

Referring now to FIG. 5, the third blank 80 is shown. Blank 80 and blank 50 are of identical configuration. Blank 80 includes end panel 82, glue flaps 84 and 86 connected to the end panel along hinge lines 88 and 90, and a sealer flap 94 connected to the end panel along hinge line 92. The sealer flap 94 is connected to the glue flaps 84, 86 along diagonal lines of cut 96 and 98 which define primary seal portions 100, 102 at the corners.

Referring now to FIGS. 1 and 2, a box comprised of the blanks illustrated in FIGS. 3, 4 and 5 is shown, FIG. 1 showing the box fully assembled and FIG. 2 showing the top closure panel 22 partially open and partially broken away to illustrate details of the box interior. The pair of end panels 52 and 82 are disposed in communication with the front, bottom and back panels at the ends thereof with the front, bottom and back panel glue flaps overlapping the end panels and secured to the outer surfaces of the end panels as by means of adhesive. The glue flaps of the end panels on the other hand are secured as by means of adhesive in engagement with the inner surfaces of the front and back panels. In this manner, inside and outside flanges are provided at each corner of the box to provide stacking strength. After the box is filled with the desired contents, the top closure panel 22 is folded along its hinge line 24 so that it closes the box. Sealer flaps 64 and 94 are then folded inwardly over top closure panel 22. Closure flap 30 is then secured to the front panel 12 as by means of adhesive. Likewise, sealer flaps 64 and 94 are secured to top closure panel 22 as by means of adhesive.

Figure 8:
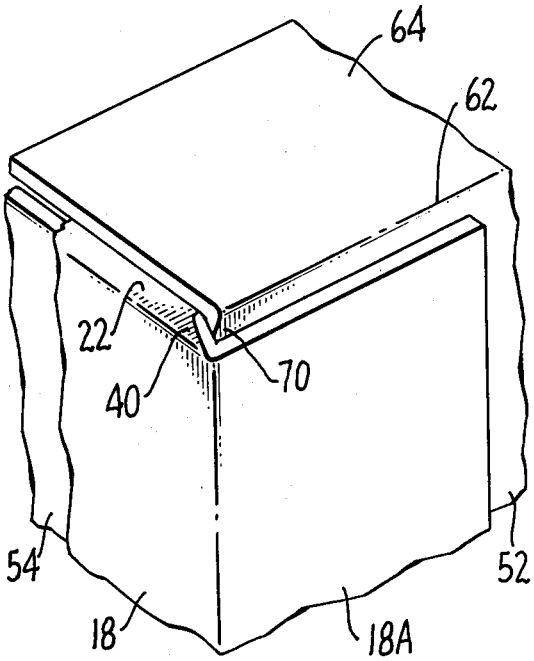
FIGS. 8 and 9 are enlarged isometric views showing details of rear and front upper leak-proof corners of the box when assembled.

Due to the unique construction of the box, final closure of the top closure panel and the sealer flaps results in a sift or leak-proof arrangement at the upper corners and along the upper ends of the box. As may be seen with particular reference to FIGS. 8 and 9, the top closure panel 22 and sealer flaps 64 and 94 cooperate to from sift-proof corner seals. At the back of the box, depression of sealer flaps 64 and 94 over top closure panel 22 brings auxiliary seal portions 40, 42 into cooperative engagement with primary seal portions 70, 100, respectively, to completely seal off the two back corners. FIG. 8 shows this particular interrelationship between seal portions 40 and 70 wherein it will be noted that the lines of cut 36 and 66 which define seal portions 40 and 70 define a generally X-shaped configuration with respect to one another.

Figure 9:
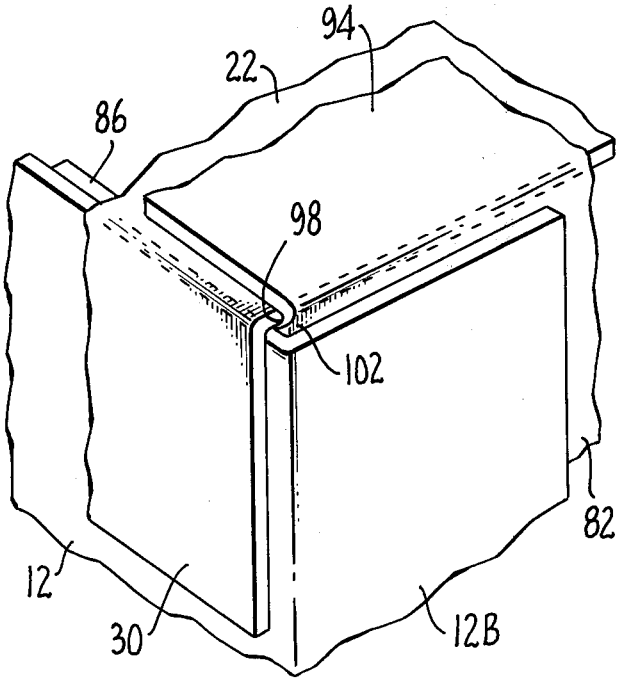

At the front of the box, upon adhesive securing of the closure flap 30 and sealer flaps 64 and 94, primary seal portions 72, 102 completely close off the top front corners, as shown with particular regard to primary seal portion 102 in FIG. 9. It will be noted that line of cut 98 defines a generally X-shaped configuration with the cooperating end of top closure panel 22 with the seal portion 98 in cooperative engagement with the top closure panel.

Thus, the box according to the present invention is readily adapted to the storage and transport of granular, powdered and other similar materials wherein a leak-proof box is desired. The contents of the box may be dispensed by opening same along lines of weakness 110 for example. Any suitable dispensing arrangement may be utilized however.

We claim as our invention:

1. A leak-proof box comprising:

a main body blank of unitary construction and including a front panel, a bottom panel connected to the front panel, a back panel connected to the bottom panel, a top closure panel connected to the back panel along a hinge line and a closure flap connected to said top closure panel and adapted to be brought into engagement with said front panel to close said box, and glue flaps attached along hinge lines to the ends of said bottom, front and back panels; and a pair of end panels disposed in communication with said front, bottom and back panels at the ends thereof, said front, bottom and back panel glue flaps overlapping the end panels and secured to the outer surfaces of said end panels, glue flaps attached to said end panels along hinge lines and secured in engagement with the inner surfaces of said front and back panels, sealer flaps hingedly connected to said end panels and adapted to be folded inwardly over said top closure panel to form a leak-proof seal therewith when said closure flap is secured to the front panel, said sealer flaps being connected to their respective end panel glue flaps along lines of cut defining primary seal portions at the upper box corners when the closure flap is secured to the front panel.

2. The box according to claim 1 wherein said top closure panel is connected to the glue flaps of said back panel along diagonal lines of cut defining auxiliary seal portions cooperatively engaging the primary seal portions defined by the lines of cut extending from the sealer flaps and the end panel glue flaps that are in engagement with the back panel.

3. The box according to claim 2 wherein the diagonal lines of cut defining the primary seal portions extending from the sealer flaps and the end panel glue flaps that are in engagement with the back panel define a generally X-shaped configuration with the lines of cut defining the auxiliary seal portions.

4. The box according to claim 1 wherein the lines of cut extending from the sealer flaps and the end panel glue flaps that are in engagement with the front panel define a generally X-shaped configuration with the end of the top closure panel in the vicinity of the closure flap.

5. A blank for a leak-proof box comprising:

a first blank of generally rectangular configuration and including in seriatim a front panel, a bottom panel hingedly connected to the front panel, a back panel hingedly connected to the bottom panel and a top closure panel hingedly connected to the back panel, a closure flap hingedly connected to said top closure panel, and glue flaps hingedly connected to opposed ends of said front, bottom and back panels;

second and third blanks of identical construction, each of said second and third blanks adapted to be secured to said first blank to form an assembled leak-proof box and including a generally rectangular-shaped end panel having glue flaps hingedly connected at opposed ends and a sealer flap connected to the end panel along a hinge line extending between said opposed ends and connected to the end panel glue flaps along diagonal lines of cut to define primary seal portions adapted to form a sift-proof seal when the box is assembled.

6. The blank construction according to claim 5 wherein the top closure panel of said first blank is connected to the glue flaps of said back panel along diagonal lines of cut defining auxiliary seal portions adapted, when the box is assembled, to cooperatively engage the primary seal portions defined by the lines of cut extending from the sealer flaps and the end panel glue flaps that are in engagement with the back panel.

* * * * *